US009611872B2

(12) United States Patent
Finley

(10) Patent No.: US 9,611,872 B2
(45) Date of Patent: Apr. 4, 2017

(54) RECIPROCAL HYDRAULIC CYLINDER AND POWER GENERATION SYSTEM

(71) Applicant: John Russell Finley, St. Jacob, IL (US)

(72) Inventor: John Russell Finley, St. Jacob, IL (US)

(73) Assignee: John Russell Finley, St. Jacob, IL (US)

( * ) Notice: Subject to any disclaimer, the term of this patent is extended or adjusted under 35 U.S.C. 154(b) by 317 days.

(21) Appl. No.: 14/249,813

(22) Filed: Apr. 10, 2014

(65) Prior Publication Data

US 2014/0305111 A1 Oct. 16, 2014

Related U.S. Application Data

(60) Provisional application No. 61/811,306, filed on Apr. 12, 2013.

(51) Int. Cl.

| | |
|---|---|
| ***F15B 15/20*** | (2006.01) |
| ***F15B 11/15*** | (2006.01) |
| ***F01B 11/00*** | (2006.01) |
| ***F01B 7/16*** | (2006.01) |

(52) U.S. Cl.

CPC ..... *F15B 15/204* (2013.01); *F01B 7/16* (2013.01); *F01B 11/001* (2013.01); *F01B 11/009* (2013.01); *F15B 11/15* (2013.01)

(58) Field of Classification Search

CPC F15B 15/204; F15B 11/15; F01B 7/16; F01B 11/001; F01B 11/009

USPC ..... 60/398; 91/275

See application file for complete search history.

(56) References Cited

U.S. PATENT DOCUMENTS

| | | | | |
|---|---|---|---|---|
| 2,258,464 | A * | 10/1941 | Moody | B63B 39/03 114/125 |
| 3,853,036 | A * | 12/1974 | Eskridge | F01L 25/04 91/276 |
| 4,208,878 | A | 6/1980 | Rainey | |
| 4,945,815 | A * | 8/1990 | Lo | B25D 9/14 91/234 |
| 8,677,886 | B2 | 3/2014 | Cronin et al. | |
| 8,683,796 | B1 | 4/2014 | Langenfeld et al. | |
| 2011/0131966 | A1* | 6/2011 | McBride | F04B 17/03 60/415 |

OTHER PUBLICATIONS

International Search Report and Written Opinion mailed Aug. 27, 2014 re International Application No. PCT/US2014/033680, 16 pages.

* cited by examiner

*Primary Examiner* — Thomas E Lazo

(74) *Attorney, Agent, or Firm* — Armstrong Teasdale LLP

(57) ABSTRACT

A hydraulic cylinder is provided. The hydraulic cylinder includes a casing with a longitudinal axis defined therethrough, a first fluid inlet defined in the casing, a second fluid inlet defined in the casing, a first fluid outlet defined in the casing, a second fluid outlet defined in the casing, a shaft extending along the longitudinal axis, a first switching valve mounted to the shaft, a second switching valve mounted to the shaft, and a piston mounted to the shaft between the first switching valve and the second switching valve, wherein the hydraulic cylinder is configured such that when a fluid is supplied to the first and second fluid inlets, the shaft, the first and second switching valves, and the piston oscillate back and forth along the longitudinal axis.

13 Claims, 4 Drawing Sheets

RECIPROCAL HYDRAULIC CYLINDER AND POWER GENERATION SYSTEM

CROSS REFERENCE TO RELATED APPLICATIONS

This application is a non-provisional application and claims priority to U.S. Provisional Patent Application Ser. No. 61/811,306 filed Apr. 12, 2013 for "RECIPROCAL HYDRAULIC CYLINDER AND POWER GENERATION SYSTEM", which is hereby incorporated by reference in its entirety.

BACKGROUND OF THE INVENTION

The subject matter disclosed herein relates generally to power generation and, more specifically, to a reciprocal hydraulic cylinder for generating power.

Known power generation systems include gas turbine engines, wind turbines, solar panels, and other similar devices. These devices typically convert one form of energy (e.g., fuel, wind, heat) to another to generate power. However, at least some known power generation systems are relatively inefficient, consuming significantly larger amounts of energy than they are capable of producing. Further, the more inefficient a power generation system is, the more costly it is to operate, and the longer it takes to produce a given amount of energy. Moreover, at least some known power generation systems consume fuels to generate power, and constantly require new fuel to continue operating, which may be relatively expensive.

BRIEF DESCRIPTION OF THE INVENTION

In one aspect, a hydraulic cylinder is provided. The hydraulic cylinder includes a casing with a longitudinal axis defined therethrough, a first fluid inlet defined in the casing, a second fluid inlet defined in the casing, a first fluid outlet defined in the casing, a second fluid outlet defined in the casing, a shaft extending along the longitudinal axis, a first switching valve mounted to the shaft, a second switching valve mounted to the shaft, and a piston mounted to the shaft between the first switching valve and the second switching valve, wherein the hydraulic cylinder is configured such that when a fluid is supplied to the first and second fluid inlets, the shaft, the first and second switching valves, and the piston oscillate back and forth along the longitudinal axis.

In another aspect, a method for generating power is provided. The method includes providing input power to a hydraulic cylinder from an input device, the hydraulic cylinder including a casing, a first fluid inlet defined in the casing, a second fluid inlet defined in the casing, a first fluid outlet defined in the casing, a second fluid outlet defined in the casing, a shaft extending along the longitudinal axis, a first switching valve mounted to the shaft, a second switching valve mounted to the shaft, and a piston mounted to the shaft between the first switching valve and the second switching valve. The method further includes driving the hydraulic cylinder using the input power such that the shaft, the first and second switching valves, and the piston oscillate back and forth along the longitudinal axis to generate an output power, and providing the output power to an output device.

In yet another aspect, a power generation system is provided. The power generation system includes an input device, a hydraulic cylinder configured to receive input power from the input device, the hydraulic cylinder including a casing having a longitudinal axis, a pair of fluid inlets defined in the casing, a pair of fluid outlets defined in the casing, and a shaft extending along the longitudinal axis, wherein the hydraulic cylinder is configured such that when a fluid is supplied to the pair of fluid inlets, the shaft oscillates back and forth along the longitudinal axis to generate an output power. The power generation system further includes an output device configured to receive the output power.

DETAILED DESCRIPTION OF THE INVENTION

The systems and methods described herein facilitate generation of power using a hydraulic cylinder. By supplying fluid to the hydraulic cylinder from a fluid source, a shaft is driven back and forth along a longitudinal axis of the cylinder. The force from the motion of the shaft may be used to generate power for operating the fluid source, as well as other devices.

Figure 1:
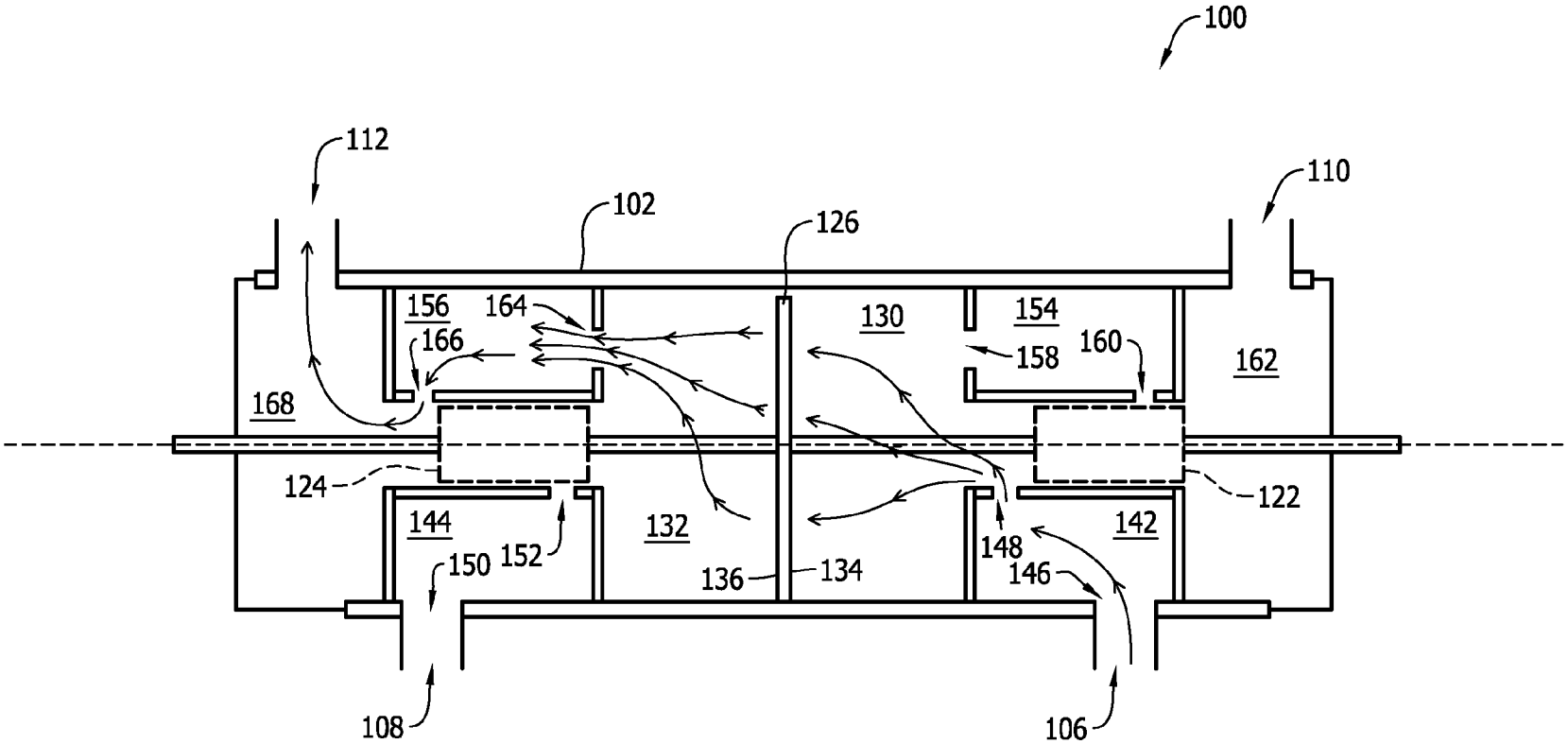
FIG. 1 is a schematic cross-sectional view of an exemplary hydraulic cylinder.

FIG. 1 is a schematic cross-sectional view of an exemplary hydraulic cylinder 100. In the exemplary embodiment, hydraulic cylinder 100 includes a substantially cylindrical casing 102 with a longitudinal axis 104 defined therethrough. Hydraulic cylinder 100 may also be referred to herein as a reciprocal cylinder, as pumping fluid through hydraulic cylinder 100 causes cylinder 100 to undergo a cyclical process to generate power, as described in detail below. Although hydraulic cylinder 100 is cylindrical (i.e., having a circular cross-section extending along longitudinal axis) in the exemplary embodiment, alternatively, hydraulic cylinder 100 may have any shape (e.g., a square, triangular, or pseudo-square cross-section extending along longitudinal axis) that enables hydraulic cylinder 100 to function as described herein.

A first fluid inlet 106, a second fluid inlet 108, a first fluid outlet 110, and a second fluid outlet 112 are defined in casing 102. First and second fluid inlets 106 and 108 are in flow communication with a fluid source (not shown in FIG. 1). Hydraulic cylinder 100 generates power when fluid is pumped through hydraulic cylinder 100, as described in detail below. In the exemplary embodiment, the fluid pumped through hydraulic cylinder 100 is oil. Alternatively, any fluid that enables hydraulic cylinder 100 to function as described herein may be used, including, but not limited to water and/or air.

A shaft 120 extends along longitudinal axis 104 of hydraulic cylinder 100. Shaft 120 includes a first switching valve 122, a second switching valve 124, and a piston 126 mounted thereon. Accordingly, shaft 120, first and second switching valves 122 and 124, and piston 126 move with one another during operation of hydraulic cylinder 100, as described in detail below.

Piston 126 is disc-shaped and separates a first main cavity 130 and a second main cavity 132 of hydraulic cylinder 100 in the exemplary embodiment. Piston 126 is sized such that fluid does not pass between first main cavity and second main cavity 132, but with sufficient pressure, piston 126 (and accordingly shaft 120) will move relative to casing 102 along longitudinal axis 104. In some embodiments, a sealing ring (not shown) may be coupled to piston 126 to prevent fluid passing between first main cavity 130 and second main cavity 132.

Piston 126 has a first substantially planar surface 134 and a second substantially planar surface 136. Accordingly, when fluid impinges upon first substantially planar surface 134 or second substantially planar surface 136, the fluid may cause piston 126, and accordingly, shaft 120 to move along longitudinal axis 104.

In the exemplary embodiment, hydraulic cylinder 100 includes a first inlet chamber 142 and a second inlet chamber 144. First inlet chamber 142 has a first aperture 146 in fluid communication with first fluid inlet 106 and a second aperture 148 in fluid communication with first main cavity 130. Second inlet chamber 144 has a first aperture 150 in fluid communication with second fluid inlet 108 and a second aperture 152 in fluid communication with second main cavity 132.

Hydraulic cylinder 100 further includes a first outlet chamber 154 and a second outlet chamber 156. First outlet chamber 154 includes a first aperture 158 in fluid communication with first main cavity 130 and a second aperture 160 in fluid communication with a first outlet cavity 162. First outlet cavity 162 is in flow communication with first fluid outlet 110. Second outlet chamber 156 includes a first aperture 164 in fluid communication with second main cavity 132 and a second aperture 166 in fluid communication with a second outlet cavity 168. Second outlet cavity 168 is in flow communication with second fluid outlet 112.

First and second switching valves 122 and 124 are substantially cylindrical, and are sized to block (i.e., seal such that no fluid passes through) first inlet chamber second aperture 148, second inlet chamber second aperture 152, first outlet chamber second aperture 160, and/or second outlet chamber second aperture 166 depending on a position of shaft 120 along longitudinal axis 104. Specifically, first switching valve 122 either blocks first inlet chamber second aperture 148 or first outlet chamber second aperture 160, and second switching valve 124 either blocks second inlet chamber second aperture 152 or second outlet chamber second aperture 166.

Operation of hydraulic cylinder 100 will now be described in detail. To operate cylinder 100, fluid is supplied to first and second fluid inlets 106 and 108. As shown in FIG. 1, in an initial configuration, second inlet chamber second aperture 152 is blocked by second switching valve 124, and first inlet chamber second aperture 148 is open. Accordingly, fluid flows into first inlet chamber 142 from first fluid inlet 106, and subsequently flows through first inlet chamber second aperture 148 into first main cavity 130. As fluid flows into first main cavity 130, the fluid increases pressure in first main cavity 130 and impinges upon first substantially planar surface 134, moving shaft 120, piston 126, and first and second switching valves 122 and 124 along longitudinal axis 104 in a first direction (from right to left as shown in FIG. 1). FIG. 1 shows flow paths of the fluid through the initial configuration of hydraulic cylinder 100.

As piston 126 moves along longitudinal axis 104 in the first direction, the volume of first main cavity 130 increases and the volume of second main cavity 132 decreases. Accordingly, fluid in second main cavity 132 flows into second outlet chamber 156, through second outlet chamber second aperture 166 into second outlet cavity 168, and out second outlet 112.

At some point, as first and second switching valves 122 and 124 move along longitudinal axis 104 in the first direction, the open and blocked apertures on first and second inlet chambers 142 and 144 and first and second outlet chambers 154 and 156 are switched. That is, first switching valve 122 moves to block first inlet chamber second aperture 148 and open second outlet chamber second aperture 160, and second switching valve 124 moves to block second outlet chamber second aperture 166 and open second inlet chamber second aperture 152. In some embodiments, hydraulic cylinder 100 includes one or more restrictors (not shown) that limit the displacement of first and second switching valves 122 and 124 along longitudinal axis 104. The restrictors may extend from, for example, walls of first inlet chamber 142, second inlet chamber 144, first outlet chamber 154, and/or second outlet chamber 156.

With first inlet chamber second opening 148 blocked, fluid flows into second inlet chamber 144 from second fluid inlet 108, and subsequently flows through second inlet chamber second aperture 152 into second main cavity 132. As fluid flows into second main cavity 132, the fluid increases pressure in second main cavity 132 and impinges upon second substantially planar surface 136, moving shaft 120, piston 126, and first and second switching valves 122 and 124 along longitudinal axis 104 in a second direction opposite the first direction (from left to right as shown in FIG. 1).

As piston 126 moves along longitudinal axis 104 in the second direction, the volume of second main cavity 132 increases and the volume of first main cavity 130 decreases. Accordingly, fluid in first main cavity 130 flows into first outlet chamber 154, through first outlet chamber second aperture 160 into second outlet cavity 168, and out first outlet 110.

At some point, as first and second switching valves 122 and 124 move along longitudinal axis 104 in the second direction, the open and blocked apertures on first and second inlet chambers 142 and 144 and first and second outlet chamber 154 and 156 are switched again, restoring hydraulic cylinder 100 to the initial configuration shown in FIG. 1. Accordingly, the process is cyclical, and may be repeated multiple times in a row. Thus, by supplying fluid to hydraulic cylinder 100, shaft 120 and piston 126 are driven back and forth along longitudinal axis 104 as fluid flows through hydraulic cylinder 100. The back and forth motion of shaft 120 in the first and second direction may be used to generate electricity, as described in detail below. Notably, hydraulic cylinder 100 could also be run backwards, with first and second fluid outlets 110 and 112 operating as inlets, and first and second fluid inlets 106 and 108 operating as outlets.

Figure 2:
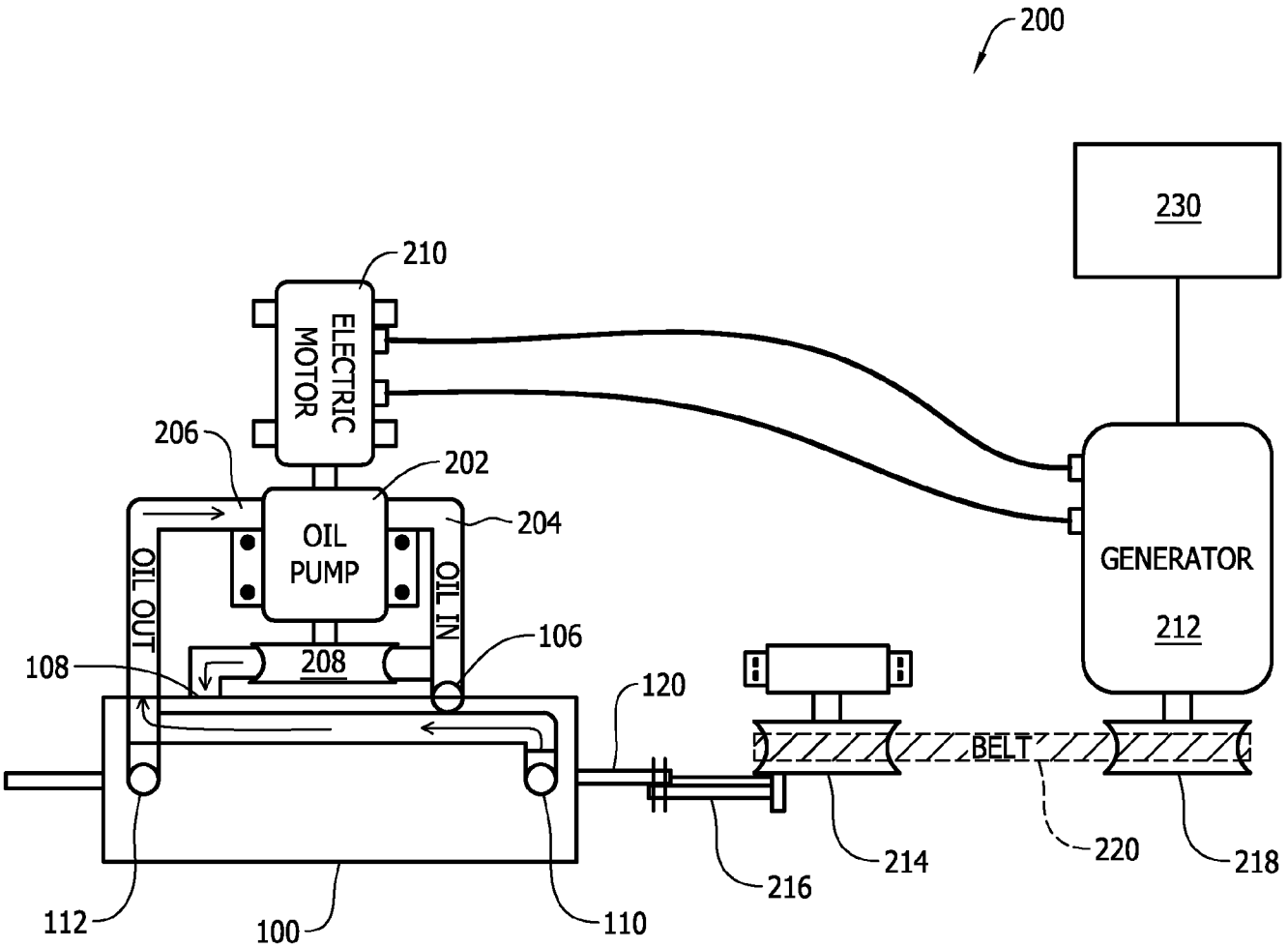
FIG. 2 is an exemplary power generation system that may be used with the hydraulic cylinder shown in FIG. 1.

FIG. 2 is a schematic diagram of an exemplary power generation system 200 that includes hydraulic cylinder 100. A fluid source 202 supplies fluid to hydraulic cylinder 100. In the exemplary embodiment, fluid source 202 is an oil pump. Alternatively, fluid source supplies any fluid to hydraulic cylinder 100 that enables hydraulic cylinder 100 to operate as described herein. Fluid source 202 supplies fluid to first and second fluid inlets 106 and 108 through a supply conduit 204. Moreover, first and second fluid outlets 110 and 112 supply return fluid to fluid source 202 via a return conduit 206 after fluid has passed through hydraulic cylinder 100. As such, fluid is not consumed during operation of hydraulic cylinder 100, but instead can be reused repeatedly to operate hydraulic cylinder 100 and drive shaft 120.

In the exemplary embodiment, fluid source 202 is started using a pull starter 208. Alternatively, fluid source 202 may be started using any suitable device that enables system 200 to function as described herein. Once started, fluid source 202 is powered using a motor 210. In the exemplary embodiment, motor 210 is an electric motor. Alternatively, motor 210 may be any motor that enables system 200 to function as described herein.

As described above, when fluid is pumped through hydraulic cylinder 100, shaft 120 is driven back and forth. In system 200, the straight line force from the movement of shaft 120 is used to power a generator 212. In the exemplary embodiment, the straight line force from shaft 120 is converted into a circular force to drive a first pulley 214 using a linkage 216 coupled between shaft 120 and first pulley 214. The first pulley 214 is coupled to a second pulley 218 via a belt 220, and rotation of second pulley 218 powers generator 212. Accordingly, the back and forth motion of piston causes generator 212 to generate electricity.

In the exemplary embodiment, the electricity generated by generator 212 is supplied to electric motor 210 to operate fluid source 202. Further, any excess electricity (i.e., more than that needed to run electric motor 210) generated by generator 212 may be supplied to one or more other devices 230. Other devices 230 may include any device configured to operate on electricity received from generator 212. Accordingly, system 200 and hydraulic cylinder 100 may be used to provide electricity to and operate other devices 230, in addition to motor 210. Alternatively, generator 212 may only provide a portion of the electricity needed to run motor 210, or may provide electricity solely to other devices 230 without supplying electricity to motor 210.

Figure 3:
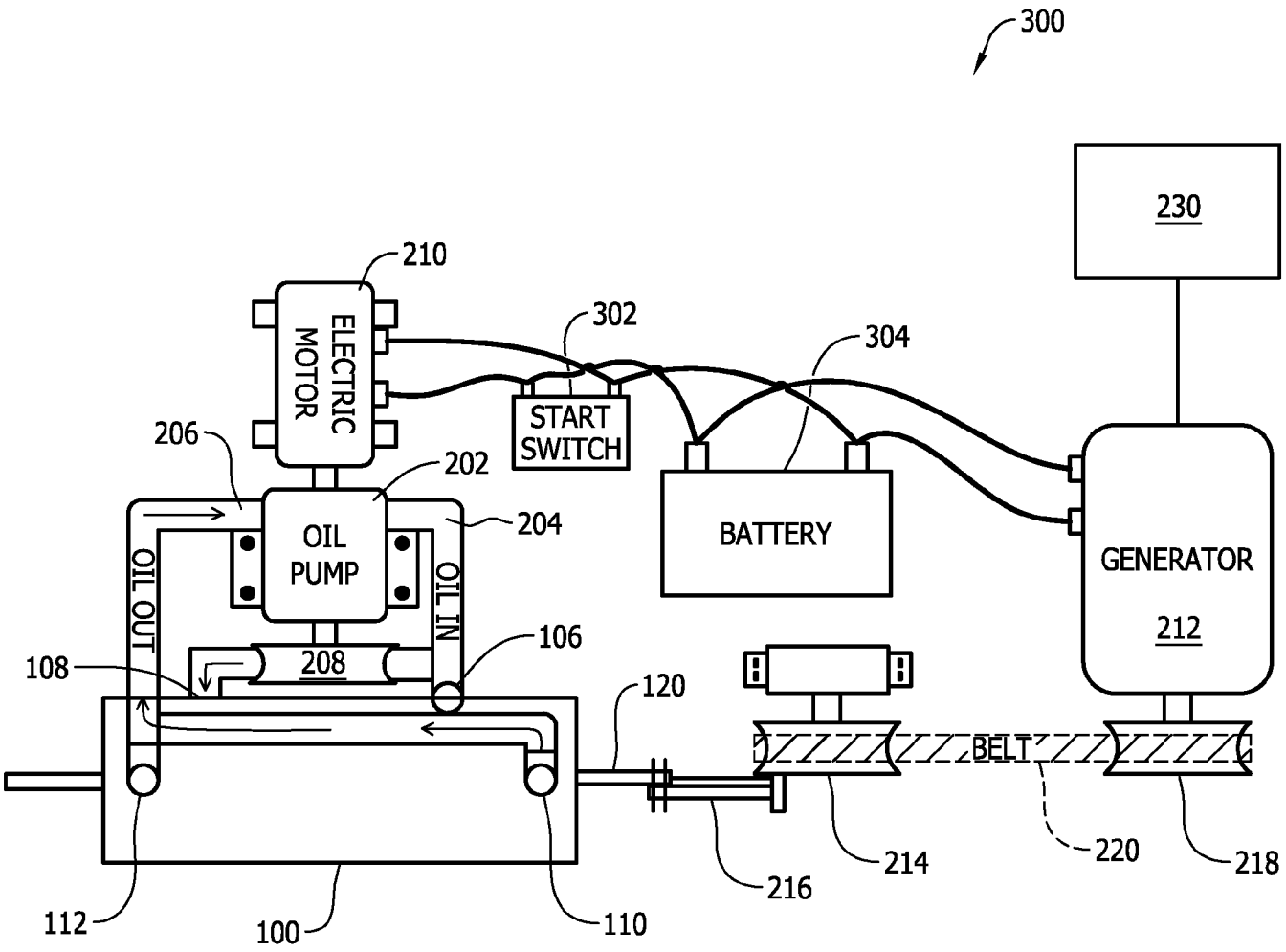
FIG. 3 is an alternative exemplary power generation system that may be used with the hydraulic cylinder shown in FIG. 1.

FIG. 3 is a schematic diagram of an alternative exemplary power generation system 300 that includes hydraulic cylinder 100. System 300 operates substantially similar to system 200 (shown in FIG. 2), except that instead of a pull starter 208, system 300 includes an electronic start switch 302 to start fluid source 202. Electronic start switch 302 is powered by a battery 304, and electricity generated by generator 212 charges battery 304.

Figure 4:
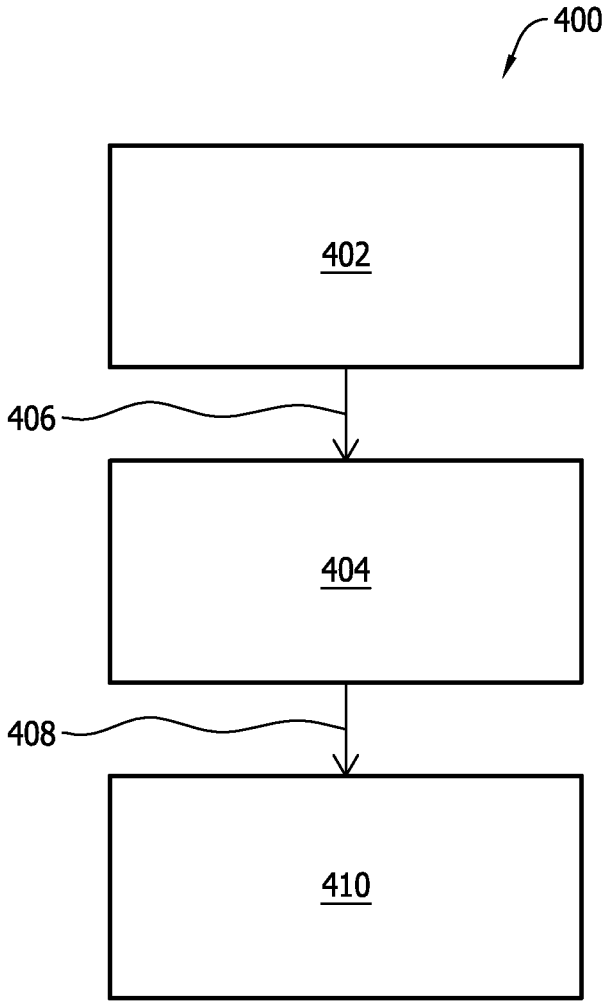
FIG. 4 is a block diagram of an exemplary power generation system that may be used with the hydraulic cylinder shown in FIG. 1.

FIG. 4 is a block diagram of an exemplary power generation system 400 that includes an input device 402 coupled to a hydraulic cylinder 404, such as hydraulic cylinder 100 (shown in FIG. 1). Input device 402 may be any device capable of providing power to hydraulic cylinder 404. In the exemplary embodiment, input device 402 provides an input power 406 to hydraulic cylinder 100. The provided input power 406 drives hydraulic cylinder 404, causing hydraulic cylinder 404 to generate an output power 408. An output device 410 receives output power 408 generated hydraulic by cylinder 404. The output device 410 may be any device capable of receiving output power 408 from hydraulic cylinder 404 and operating using the received output power 408. In the exemplary embodiment, the output power 408 may be greater than the input power 406. Accordingly, power generation system 400 may be referred to as a step-up system, and hydraulic cylinder 404 may be referred to as a step-up device.

The embodiments described herein facilitate generation of power using a hydraulic cylinder. By supplying fluid to the hydraulic cylinder from a fluid source, a shaft is driven back and forth along a longitudinal axis of the cylinder. The force from the motion of the shaft may be used to generate power for operating the fluid source, as well as other devices.

As compared to at least some known power generation systems, the hydraulic cylinder and power generation systems described herein have an improved efficiency. Accordingly, the embodiments described herein may facilitate cheaper and/or faster production of energy than at least some known power generation systems. Further, power generated from the hydraulic cylinder described herein may be used to operate both a fluid source that supplies fluid to the hydraulic cylinder as well as other devices. Moreover, unlike power generation systems that consume fuel, the fluid used to drive the hydraulic cylinder described herein may be reused repeatedly to continuously operate the hydraulic cylinder.

The methods and systems described herein are not limited to the specific embodiments described herein. For example, components of each system and/or steps of each method may be used and/or practiced independently and separately from other components and/or steps described herein. In addition, each component and/or step may also be used and/or practiced with other systems, apparatus, and methods.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

While the invention has been described in terms of various specific embodiments, those skilled in the art will recognize that the invention may be practiced with modification within the spirit and scope of the claims.

What is claimed is:

1. A hydraulic cylinder comprising:

a casing with a longitudinal axis defined therethrough;

a first fluid inlet defined in said casing;

a second fluid inlet defined in said casing;

a first fluid outlet defined in said casing;

a second fluid outlet defined in said casing;

a shaft extending along the longitudinal axis;

a first switching valve mounted to said shaft;

a second switching valve mounted to said shaft; and a piston mounted to said shaft between said first switching valve and said second switching valve, wherein said hydraulic cylinder is configured such that when a fluid is supplied to said first and second fluid inlets, said shaft, said first and second switching valves, and said piston oscillate back and forth along the longitudinal axis, wherein said casing defines a first main cavity and a second main cavity separated from said first main cavity by said piston, wherein said casing defines a first inlet chamber having a first aperture in fluid communication with said first fluid inlet and a second aperture in fluid communication with said first main cavity, and wherein said first switching valve is configured to selectively block said first inlet chamber second aperture.

2. A hydraulic cylinder in accordance with claim 1, wherein said piston is configured to prevent the fluid from passing from said first cavity to said second cavity.

3. A hydraulic cylinder in accordance with claim 1, wherein said casing further defines a first outlet chamber having a first aperture in fluid communication with said main cavity and a second aperture in fluid communication with a first outlet cavity that is in fluid communication with said first fluid outlet.

4. A hydraulic cylinder in accordance with claim 3, wherein said first switching valve is configured to selectively block said first outlet chamber first aperture.

5. A hydraulic cylinder in accordance with claim 1, wherein said first and second switching valves are substantially cylindrical and said piston is disc-shaped.

6. A method for generating power, said method comprising:

providing input power to a hydraulic cylinder from a motor, the hydraulic cylinder including a casing, a first fluid inlet defined in the casing, a second fluid inlet defined in the casing, a first fluid outlet defined in the casing, a second fluid outlet defined in the casing, a shaft extending along the longitudinal axis, a first switching valve mounted to the shaft, a second switching valve mounted to the shaft, and a piston mounted to the shaft between the first switching valve and the second switching valve;

driving the hydraulic cylinder using the input power such that the shaft, the first and second switching valves, and the piston oscillate back and forth along the longitudinal axis to generate an output power, wherein driving the hydraulic cylinder comprises pumping a fluid into the first and second fluid inlets; and providing the output power to a generator.

7. A method in accordance with claim 6, wherein the fluid is oil.

8. A method in accordance with claim 6, further comprising supplying electricity from the generator to the motor.

9. A power generation system comprising:

an input device;

a hydraulic cylinder configured to receive input power from said input device, said hydraulic cylinder comprising:

a casing having a longitudinal axis;

a pair of fluid inlets defined in said casing;

a pair of fluid outlets defined in said casing;

a shaft extending along the longitudinal axis;

a first switching valve mounted to said shaft;

a second switching valve mounted to said shaft; and a piston mounted to said shaft between said first switching valve and said second switching valve, wherein said hydraulic cylinder is configured such that when a fluid is supplied to said pair of fluid inlets, said shaft oscillates back and forth along the longitudinal axis to generate an output power; and an output device configured to receive the output power, wherein said output device is configured to supply electricity to said input device and at least one other device.

10. A power generation system in accordance with claim 9, wherein said first and second switching valves have a first diameter, and wherein said piston has a second diameter larger than said first diameter.

11. A power generation system in accordance with claim 10, wherein said casing defines a first main cavity and a second main cavity separated from said first main cavity by said piston.

12. A power generation system in accordance with claim 11, wherein said casing defines a first inlet chamber having a first aperture in fluid communication with said first fluid inlet and a second aperture in fluid communication with said first main cavity, and wherein said first switching valve is configured to selectively block said first inlet chamber second aperture.

13. A power generation system in accordance with claim 9, wherein the fluid is oil.

* * * * *